United States Patent [19]

Gerritsen et al.

[11] Patent Number: 4,691,139

[45] Date of Patent: Sep. 1, 1987

[54] DISPLAY TUBE HAVING FERROMAGNETIC FIELD SHAPERS TO PREVENT BEAM DEFOCUSSING

[75] Inventors: Jan Gerritsen; Otto Mensies, both of Eindhoven, Netherlands

[73] Assignee: U.S. Philips Corporation, New York, N.Y.

[21] Appl. No.: 627,948

[22] Filed: Jul. 5, 1984

[30] Foreign Application Priority Data

May 7, 1984 [NL] Netherlands ..... 8401444

[51] Int. Cl.[4] ..... H01J 29/50; H01J 29/70

[52] U.S. Cl. ..... 313/413; 313/431

[58] Field of Search ..... 313/412, 413, 414, 437, 313/438, 439, 426, 431

[56] References Cited

U.S. PATENT DOCUMENTS 3,866,080 2/1975 Barkow ..... 313/412
4,609,847 9/1986 Ashizaki et al. ..... 313/413

FOREIGN PATENT DOCUMENTS 2408994 11/1974 Fed. Rep. of Germany ..... 313/412
0083136 6/1980 Japan ..... 313/412
0061246 4/1982 Japan ..... 313/412
0059536 4/1983 Japan ..... 313/413
2086130 5/1982 United Kingdom ..... 313/412

*Primary Examiner*—David C. Nelms
*Assistant Examiner*—William L. Oen
*Attorney, Agent, or Firm*—Thomas A. Briody; Jack Oisher; William J. Streeter

[57] ABSTRACT

A display tube comprising an evacuated envelope having a display window, a conical portion and a neck, and an electron gun in the neck for generating an electron beam which is focused to form a spot on a display screen on the display window, the electron beam being deflected over the display screen in mutually perpendicular directions by pin-cushion-shaped deflection fields produced by a system of deflection coils. Field shapers are provided at the gun end of the tube which comprise two mutually perpendicular pairs of flat plates of ferromagnetic sheet material, the respective pairs of plates being arranged coaxially around the electron beam and respectively extending in the respective deflection directions. The plates are supported so that the gun ends thereof are at substantially the same distance from the electron gun, and cause the edge fields of the deflection fields to be barrel-shaped so as to prevent defocusing of the beam by the pin-cushion deflection fields.

2 Claims, 9 Drawing Figures

DISPLAY TUBE HAVING FERROMAGNETIC FIELD SHAPERS TO PREVENT BEAM DEFOCUSSING

BACKGROUND OF THE INVENTION

1. Field of the Invention

The invention relates to a display tube comprising an evacuated envelope consisting of a display window, a cone, and a neck, and an electron gun for generating an electron beam which is focused to form a spot on a display screen provided on the inside of the display window, said spot being deflected over said display screen in two substantially mutually perpendicular directions by deflection fields of a system of deflection coils. It particularly relates to means for shaping such deflection fields so as to minimize defocusing of the electron beam over the display screen.

2. Description of the Related Art

Such a display is used, for example, in a device for displaying symbols and/or figures generated, for example, by a computer. Such a display tube is also termed a D.G.D.-tube (D.G.D.=Data Graphic Display).

Such a display tube is known, for example, from "Philips Data Handbook", Electron Tubes, part 8, July, 1983, Monitor Tubes.

In such tubes deflection coils are used in which the generated line deflection field, but usually also the field deflection field, is made pincushion-shaped to minimize the frame distortion. As is known, however, such pincushion-shaped deflection fields also influence the shape of the electron beam and hence the shape of the spot on the display screen which is the result of said beam. In D.G.D.-tubes it is highly desirable for the spot dimensions not to vary too much over the whole display screen, so that symbols and figures are displayed substantially equally sharply in the center, in the corners and at the edge of the display screen. In order to reduce deflection defocusing it is known to use field shapers in colour display tubes (see, for example, U.S. Pat. No. 4,346,327, PHN 9052).

SUMMARY OF THE INVENTION

It is the object of the invention to provide structurally simple field shapers for a display tube of the type mentioned in the opening paragraph which can be provided in a simple manner.

According to the invention, a display tube of the kind mentioned in the opening paragraph is characterized in that the edge fields of the deflection fields on the electron gun side of the system of deflection coils are made barrel-shaped by means of field shapers, which field shapers comprise a four flat plates of a ferromagnetic sheet material arranged around the electron beam and extending away from the electron beam substantially in the deflection directions and which are supported so that the gun ends thereof are all at a substantially equal distance from said electron gun.

The local barrel-shaped distortion of the deflection fields has for its result that the spot distortion is considerably reduced at the edge but in particular in the corners of the display screen. The field shapers can simply be cut from ferromagnetic sheet material and be connected to the centring plate on the gun end. Moreover it has been found that such field shapers may result in an increase of the deflection sensitivity.

If extra plates of ferromagnetic material are present at the ends of at least two of the plates remote from the electron beam, which plates are situated at the same distances from the electron beam in a deflection direction, said extra plates extending substantially perpendicularly to the field to be shaped, the barrel-shaped distortion of the field is still somewhat more pronounced, but there is substantially no increase of the deflection sensitivity. Because in many types of coils the line deflection field extends less far towards the electron gun than the field deflection field, the field shapers for the line deflection field preferably extend from the gun over a larger distance along the electron beam than the field shapers for the field deflection field. This is the case in particular in so-called "hybrid" deflection coils (deflection coils with both saddle-shaped and toroidal coils).

The plates extending away from the electron beam in the deflection directions preferably comprise slots extending in the deflection directions so as to prevent eddy currents in the field shapers. For that purpose, the extra plates of ferromagnetic material may also comprise slots. Said slots are important in particular in the field shapers or parts of field shapers extending substantially perpendicularly to the line field, because said deflection field varies with the highest frequency (line frequency).

BRIEF DESCRIPTION OF THE DRAWINGS

The invention will now be described in greater detail with reference to the drawings, in which.

DESCRIPTION OF THE PREFERRED EMBODIMENTS

Figure 1:
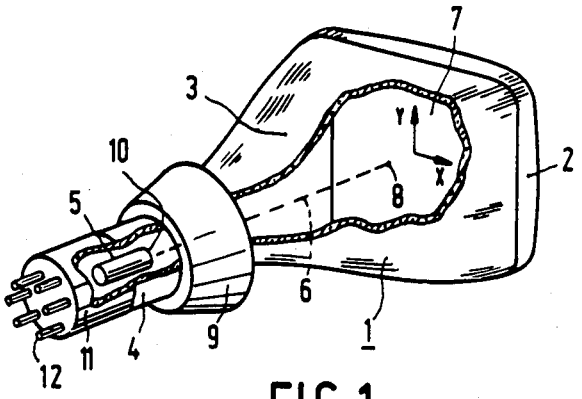
FIG. 1 is a perspective view partly broken away of a display tube according to the invention.
Figure 2:
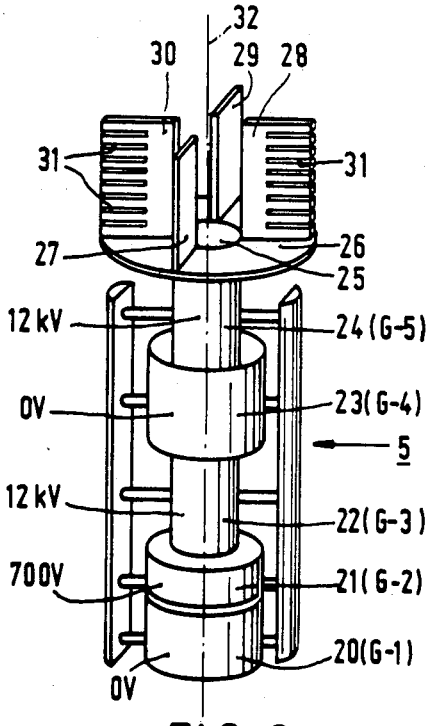
FIG. 2 is a perspective view of an electron gun according to the invention.

FIG. 1 is a perspective view partly broken away of a display tube according to the invention. This tube comprises in the neck of a glass envelope 1 which consists of a display window 2, a cone 3 and said neck 4, an electron gun 5 for generating an electron beam 6. Said electron beam 6 is focused on a display screen 7 to form a spot 8. The display screen 7 is provided on the inside of the display window 2. The electron beam is deflected over the display screen 7 in two mutually perpendicular directions x, y by means of the system of deflection coils 9. In order to prevent or considerably reduce frame distortion of the frame to be written on the display screen 7 by means of the electron beam 6, the deflection fields have been made pincushion-shaped. The resulting deflection field defocusing of the electron beam can be reduced by means of the field shapers as shown in FIG. 2. These field shapers are provided at the end 10 of the electron gun 5 facing the system of deflection coils. The tube has a base 11 with connection pins 12.

FIG. 2 is a perspective view of the electron gun 5 of the tube shown in FIG. 1. This electron gun has a control grid (G-1) 20, a second grid (G-2) 21 and a focusing lens consisting of the electrodes 22, 23 and 24 (G-3, G-4 and G-5, respectively). The cathode, not visible, is present in the control grid. The voltages applied to the electrodes are indicated in the Figure. A centring plate 26 having apertures 25 is connected to electrode 24. The centering springs for centring the electron gun in the tube neck are connected to said plate, which centering springs are not shown in the Figure. The edge field of the pincushion-shaped deflection fields of the system of deflection coils 9 (see FIG. 1) is made barrel-shaped by the field shapers 27, 28, 29 and 30, as will be explained hereinafter with reference to the following Figures. Slots 31 to reduce the occurrence of eddy currents are provided in the field shapers 28 and 30 which are perpendicular to the line field. Of course it is also possible to provide the field shapers 27 and 29 with such slots. The field shapers have a length, for example, of 10 mm measured in the direction of the electron gun axis 32. The width is, for example, 4.8 mm and the thickness 0.25 mm. The field shapers may be cut from sheet material consisting of NiFe (with 48% of Ni) and may be connected to the centring plate 26 by means of spot-welds.

The results recorded in the Table below are obtained with the above-described electron gun.

| Spot dimensions (mm) | Without field shapers | With field shapers |
|---|---|---|
| Center | | |
| dx | 0.70 | 0.70 |
| dy | 0.70 | 0.70 |
| N/S | | |
| dx | 1.05 | 0.93 |
| dy | 1.10 | 0.95 |
| average increase | 55% | 35% |
| E/W | | |
| dx | 1.15 | 1.15 |
| dy | 1.15 | 1.08 |
| average increase | 65% | 65% |
| Corners | | |
| dx | 1.29 | 1.05 |
| dy | 1.15 | 0.92 |
| average increase | 75% | 40% |

dx and dy are the spot dimensions in mm in the centre of the display screen, on the upper and lower sides of the display screen (N/S), on the left and right-hand sides of the display screen (E/W) and in the corners of the display screen. By using the invention the average increase of the spot dimensions (in %) is considerably reduced especially in the corners of the display screen. The spot dimensions apply to an electron beam current of approximately 100 μA in a display tube having a picture diagonal of 31 cm and 90° deflection of the electron beam.

It is possible to make one set of field shapers, for example field shapers 27 and 29, longer (for example 14 mm) than the field shapers 28 and 30. As a result of this the average increase of the spot on the left and right-hand sides of the display screen (E/W) is extra reduced as compared with the above Table.

Figure 3:
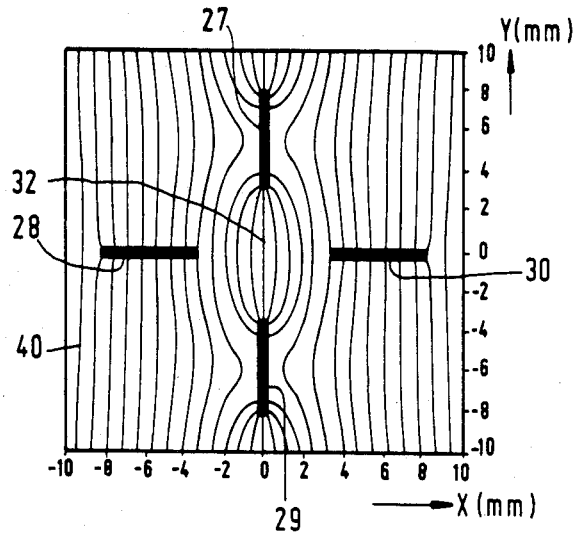
FIG. 3 shows the barrel-shaped distortion of a pincushion-shaped deflection field by field shapers according to the invention.

FIG. 3 shows the barrel-shaped distortion of a pincushion-shaped line deflection field by the field shapers 27, 28, 29 and 30, a number of field lines 40 of which are shown.

Figure 4:
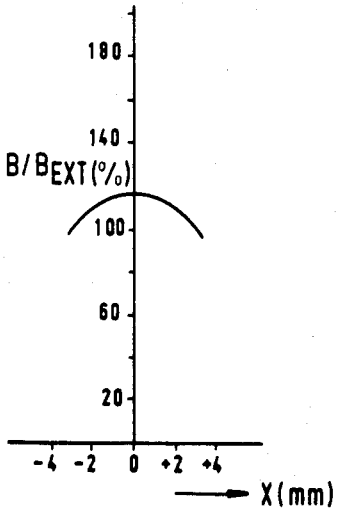
FIG. 4 shows the magnetic field strength B divided by the applied field strength $B_{ext}$ in percent. as a function of the distance to the axis of the electron gun in the deflection direction of the field shown in FIG. 3, FIG. 5 also shows this in the direction perpendicular to the deflection direction of the field shown in FIG. 3.

FIG. 4 shows the magnetic field strength B divided by the applied field strength $B_{ext}$ in percent. as a function of the distance to the axis 32 of the electron gun 5 in the deflection direction of the FIG. 3 field. This normalized field strength in the centre (x=0) is larger than 100%, as a result of which the deflection sensitivity still increases somewhat.

Figure 5:
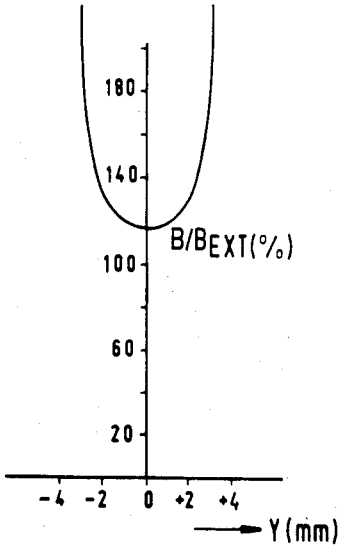

FIG. 5 shows the magnetic field strength B divided by the applied field strength $B_{ext}$ in percent. as a function of the distance to the axis 32 of the electron gun 5 in the direction of the field 40 shown in FIG. 3.

Figure 6:
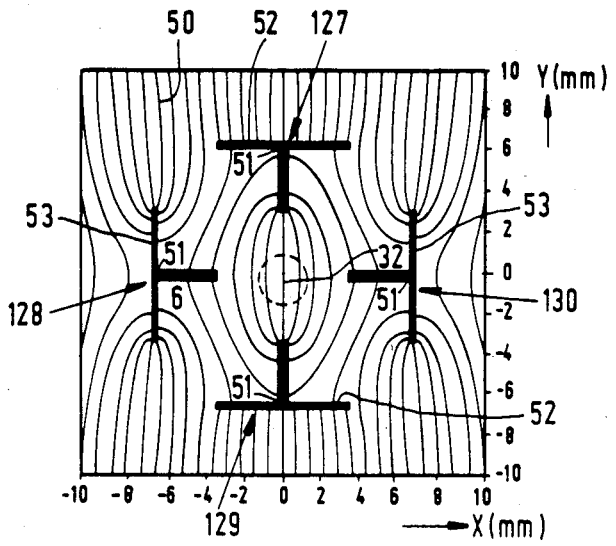
FIG. 6 shows the barrel-shaped distortion of a pincushion-shaped deflection field by another type of field shapers according to the invention.

FIG. 6 shows the barrel-shaped distortion of a pincushion-shaped line deflection field by T-shaped field shapers 127, 128, 129, 130, a number of field lines 50 of which are shown. At the ends 51 of the plates remote from the electron beam 6 and extending away from the electron beam, extra plates 52 and 53 of ferromagnetic material are connected which extend substantially perpendicularly to the field to be shaped. The plates 52 extend substantially perpendicularly to the line field shown and the plates 53 extend substantially perpendicularly to the frame field not shown.

Figure 7:
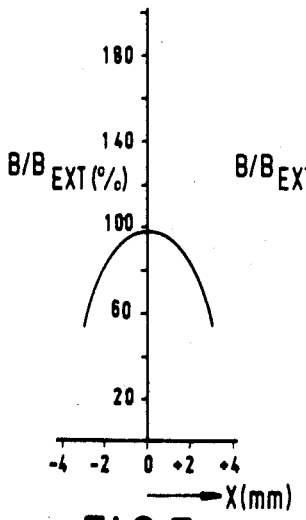
FIG. 7 shows the magnetic field strength B divided by the applied field strength $B_{ext}$ in percent. as a function of the distance to the axis of the electron gun in the deflection direction of the field shown in FIG. 6, FIG. 8 also shows this in the direction perpendicular to the deflection direction of the field shown in FIG. 6.
Figure 8:
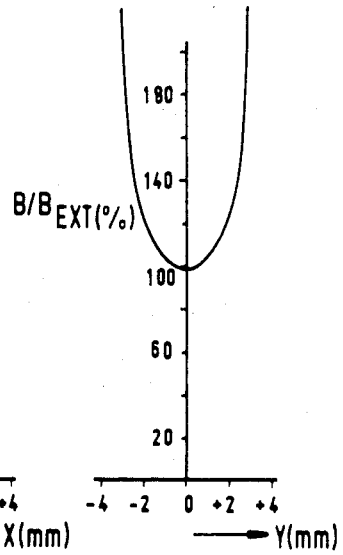

FIGS. 7 and 8 are analogous to FIGS. 4 and 5. In the centre the normalized field strength is approximately 100%. The field is made more barrel-shaped than with the field shapers shown in FIG. 3. No increase of the deflection sensitivity occurs.

Figure 9:
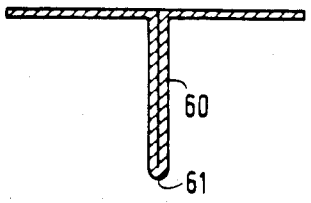
FIG. 9 is a sectional view of a T-shaped field shaper.

FIG. 9 is a sectional view of a T-shaped field shaper 60 which is manufactured from one piece of sheet material. The radius of curvature of the end 61 must be chosen to be as small as possible so as to obtain a field which is barrel-shaped as well as possible.

What is claimed is:

1. In a display tube comprising an evacuated envelope having a display window, a conical portion and a neck, an electron gun in such neck for generating an electron beam within the envelope which is focussed to form a spot on a display screen on the display window, and a system of deflection coils mounted on said envelope producing pin-cushion-shaped deflection fields for deflecting such spot over the display screen in mutually perpendicular line and field directions; the improvement characterized in that the edge fields of the deflection fields at the electron gun end of the system of deflection coils are made barrel-shaped by means of field shapers, such field shapers comprising two mutually perpendicular pairs of thin, flat plates of ferromagnetic sheet material arranged coaxially around the electron beam and respectively laterally extending away from the electron beam substantially in the line and field deflection directions, both of such pairs of plates being supported on a planar centering member so that the gun ends thereof are at substantially the same distance from said electron gun; whereby such plates minimize defocusing of the electron beam caused by the pin-cushion-shaped deflection fields.

2. A display tube as claimed in claim 1, further characterized in that the pair of plates which laterally extend in the line deflection direction extend a greater distance along the electron beam than the pair of plates which laterally extend in the field deflection direction.

* * * * *